United States Patent [19]

Ross

[11] Patent Number: 4,531,905

[45] Date of Patent: Jul. 30, 1985

[54] OPTIMIZING COMBUSTION AIR FLOW

[75] Inventor: Charles W. Ross, Lansdale, Pa.

[73] Assignee: General Signal Corporation, Stamford, Conn.

[21] Appl. No.: 532,344

[22] Filed: Sep. 15, 1983

[51] Int. Cl.[3] ..... F23N 5/00

[52] U.S. Cl. ..... 431/12; 431/76; 236/15 E

[58] Field of Search ..... 431/12, 76; 236/15 BD, 236/15 E

[56] References Cited

U.S. PATENT DOCUMENTS

| | | | |
|---|---|---|---|
| 3,723,047 | 3/1973 | Baudelet de Livois | 431/76 |
| 4,330,260 | 5/1982 | Jorgensen et al. | 431/12 |
| 4,360,336 | 11/1982 | Shepherd | 431/12 |
| 4,362,499 | 12/1982 | Nethery | 431/12 |

FOREIGN PATENT DOCUMENTS

| | | | |
|---|---|---|---|
| 0131623 | 10/1980 | Japan | 431/76 |

OTHER PUBLICATIONS

The CO—$O_2$—$CO_2$ *Relationship In Combustion Control;* Watson, Alfred; "Instrumentation in the Power Industry—vol. 24", 1981; Instrument Society of America; ISBN 0-87644-520-1; pp. 1-7.

*Primary Examiner*—Margaret A. Focarino

*Attorney, Agent, or Firm*—Harold Huberfeld; William G. Miller, Jr.

[57] ABSTRACT

A method for optimizing combustion air flow to a furnace. As the air/fuel ratio changes or is periodically perturbated, the corresponding change in heat loss to the stack due to the change in the amount of combustibles in the flue gases is maintained equal to the change in heat loss to the stack due to changes in the amount of excess air in the flue gases. The control is carried out by continuously modifying the air/fuel ratio in the appropriate direction to maintain that equality.

16 Claims, 5 Drawing Figures

$$\% \text{ EXCESS AIR} = \frac{\text{TOTAL AIR W} - \text{THEORETICAL AIR}}{\text{THEORETICAL AIR}} \times 100$$

OPTIMIZING COMBUSTION AIR FLOW

BACKGROUND OF THE INVENTION

The present invention relates to the control of the air/fuel ratio, AFR, in fossil fired furnaces such as those normally used in steam boilers. More particularly this invention relates to the control of the combustion air flow in the firing of such a furnace so as to maintain the heat losses to the stack at a minimum, thus optimizing the combustion air flow.

It is desirable to carry out this control under varying operating conditions, such as:

1. Variations in fuel quality
2. Variations in the fuel-air mixing with load
3. The presence of infiltrated air
4. Burner fouling
5. The use of multiple fuels In theoretically perfect or stoichiometric combustion there is a complete reaction of all of the fuel and oxygen without unburned fuel or unreacted oxygen remaining. The last step in such a perfect combustion process is the disappearance of CO, which is consumed in combustion. As a practical matter perfect combustion is not possible and there is always a remaining quantity of CO and other combustibles such as hydrogen and particulate in the exit gases along with an excess of oxygen in the form of excess air. The presence of this excess air and the presence of the combustibles causes an increase in the stack heat losses since the heat content of the combustibles is not realized and the air as well as the combustibles must be brought up to the exit gas temperature. Thus, efficiency can be greatly affected by the quantity of excess air.

In the past, when cheap fuels were available, combustion control systems operated with a bias toward the region of excess air, preferring the small cost penalty associated with excess air as contrasted to the steep penalty associated with high CO operation. Consequently, control of the combustion air from excess oxygen has become the standard for combustion control systems. Among the limitations of the oxygen measurement are the fact that it is not a direct indicator of complete combustion. Under certain conditions excess oxygen and CO can coexist in the combustion products. This can occur, for example, due to stratification and air infiltration. Stratification arises due to incomplete mixing of combustibles. Air infiltration is also bad for oxygen measurements because the oxygen in infiltrated air causes a large error in the combustion products analysis so that the control system can be seriously misled. Thus, it will be evident that under certain conditions the oxygen measurement is not an indicator of complete combustion and the presence of unburned fuel cannot be judged on the basis of the amount of oxygen in the flue gases.

The CO measurement, unlike the oxygen measurement, is a direct indicator of complete combustion, however, as with oxygen the CO measurement is affected by infiltrated air, but not as much. The use of CO to control air/fuel ratio will control the level of unburned products, but may cause the use of uneconomical amounts of excess air. For example, if the burner gets dirty or there is poor mixing, control from CO will increase the excess air and may actually decrease fuel burning efficiency. Control from oxygen may allow, under the same conditions, an increase in combustible content of the flue gas. Thus, neither approach solves the problem of obtaining efficient combustion.

Some recent attempts have been made to use a combination of the oxygen and the CO measurements to obtain control of the air/fuel ratio so as to provide efficient operation. These have included the system mentioned by Alfred Watson in an article entitled, THE $CO—O_2—CO_2$ RELATIONSHIP IN COMBUSTION CONTROL. In that article it is proposed to use oxygen under dynamic conditions to maintain the fuel/air ratio at a state where the carbon monoxide value does not exceed 1000 ppm. High and low set points are provided for the oxygen controller which are approximately equivalent to the upper and lower CO values. Under steady state conditions CO controls the air flow. The set point is approximately 150 ppm. The system is so arranged that the high and low oxygen limits apply, even under steady state control. This method, however, would not manage to keep operation at maximum efficiency.

It is an object of this invention to overcome the problems inherent in these prior art systems and provide a control of the air/fuel ratio such that there is a minimum heat loss.

SUMMARY OF THE INVENTION

In accordance with the present invention there is provided a method for controlling the air/fuel ratio of a fossil fired furnace to optimize the output of the furnace under varying operating conditions. The steps of this method include a measurement of the change in the amount of heat loss due to combustibles in the flue gases during a change or perturbation of the combustion air, the fuel, or both. A measurement of the change in heat loss due to excess air in the flue during the same period of change or perturbation is also made. The air/fuel ratio is then modified so as to tend to maintain the measured change for the combustible losses substantially equal to the measured change for the excess air losses.

BRIEF DESCRIPTION OF THE DRAWINGS

FIG. 4 is made up of FIGS. 4A and 4B juxtaposed as shown.

DETAILED DESCRIPTION OF THE PREFERRED EMBODIMENT

Figure 1:
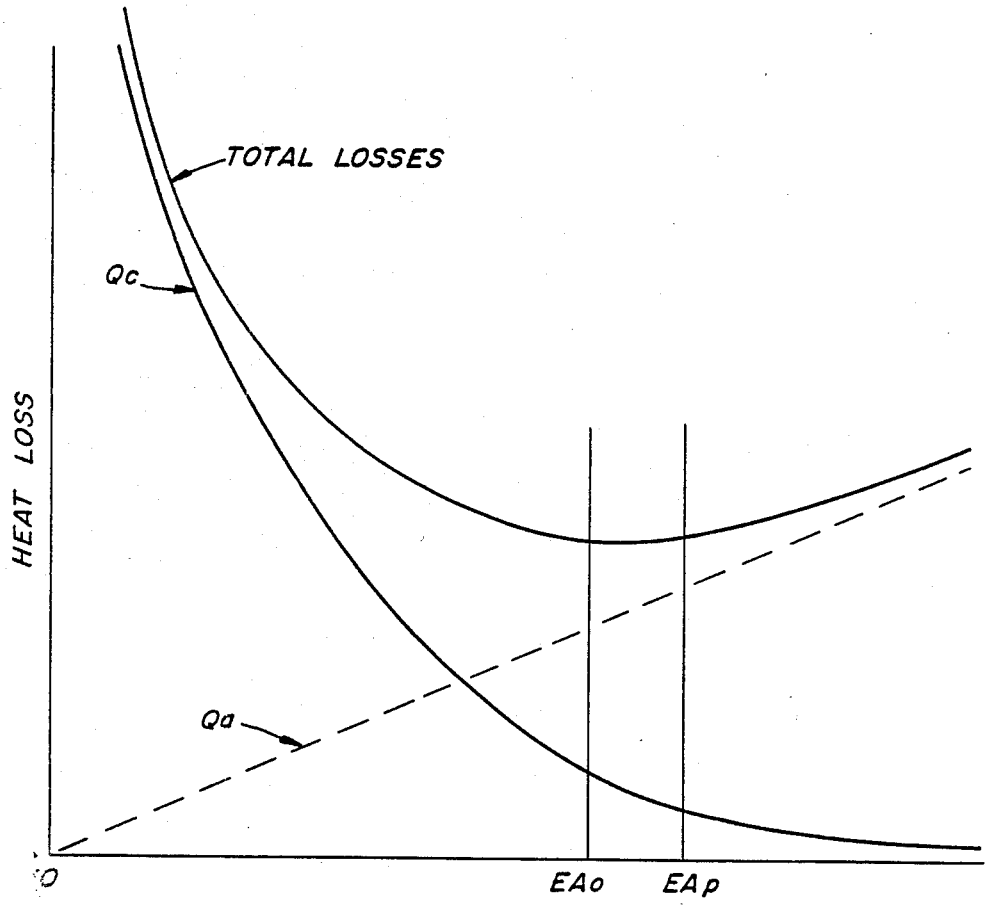
FIG. 1 graphically illustrates the relationships of the heat losses due to both excess air and the combustibles in the stack.

In FIG. 1 there is shown a curve for the HEAT LOSS vs. % EXCESS AIR. One of the curves in FIG. 1 shows the characteristic for the heat losses (Qc) which are the losses due to combustibles in the flue gases. These are the losses which result from incomplete combustion, primarily from imperfect mixing. The imperfect mixing occurs in a practical furnace around the theoretical zero excess air value. Also included in the category of combustibles is the particulate going up the flue (soot) and hydrogen. As shown in FIG. 1, when the % excess ar increases away from zero, the heat loss due to combustibles will initially decrease rapidly with the rate of change diminishing as the value for excess air goes through the operating region. The curve then levels off to a minimum for the heat loss.

FIG. 1 also shows that stack heat losses (Qa) due to excess air increases linearly with % excess air. These losses are due to the heat required to bring the excess air to the temperature of the exhaust gases. In this connection it should be kept in mind that approximately 80% of air is nitrogen and it also must be brought to the exhaust temperature along with the unused oxygen in the exhaust gases.

A combination of the two separate heat loss curves gives the total loss curve shown in FIG. 1. The minimum total loss as shown by the curve occurs where an incremental change in the losses due to excess air is equal and opposite to the incremental losses due to combustibles. Thus, the condition for minimum losses to the stack can be expressed as follows:

$$-\Delta Qc = \Delta Qa \quad (1)$$

The measurements required to determine those terms can be obtained by making the measurements before and after a change in either the rate of fuel feed or the rate of air flow or both as long as there is a change in the resulting air/fuel ratio. These changes can be small perturbations instituted solely for the purpose of making the measurement, or the measurements may be made when changes naturally occur. Frequently there are enough random fluctuations in the air/fuel ratio to provide the perturbations required.

The control of the air flow for maximum efficiency must necessarily include other factors, such as:

1. Safety
2. Pollution
3. Furnace Slagging
4. Steam Temperature

Thus, it may be necessary to control the air flow or the air/fuel ratio at some value which is not the theoretical value set forth in equation (1) solely for the purpose of maintaining mandated pollution standards governing emissions. Other factors such as safety may dictate the modification of equation (1) to provide for an offset or bias of the theoretically optimum air flow solely to gaurantee that sufficient oxygen will be available to avoid hazardous operation. To accomodate such an offset the relationship of equation (1) can be modified as follows:

$$-[1+K]\Delta Qc = \Delta Qa \quad (2)$$

so that the optimizing control of this invention will adjust the air/fuel ratio to bring the losses due to combustibles only to substantial equality with the losses due to excess air instead of the equality being absolute. Thus, it can be seen that the theoretical operating point for excess air, EA, obtained by using equation (1) may be EAo in FIG. 1 and the practical operating point may be EAp as would be obtained by using equation (2).

Operating to obtain optimization in accordance with the invention requires the calculation of an optimum air/fuel ratio or an optimum oxygen or carbon monoxide set point depending on the configuration used to control air/fuel ratio. It is desirable to interpose the optimizing calculation into the air flow side of the control rather than the fuel flow side, for the fuel must generally be modified solely to control the heat requirements thus leaving the air flow as the variable for controlling the condition of the stack gases.

Figure 2:
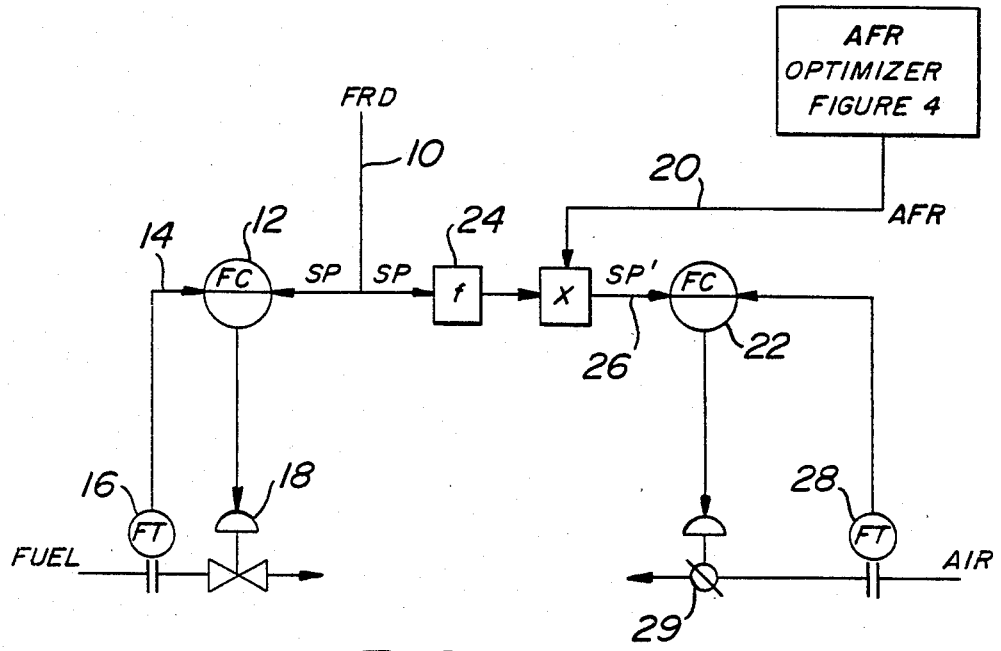
FIG. 2 illustrates one control configuration for adjusting the air/fuel ratio.

FIG. 2 shows one control arrangement for utilizing the optimum air/fuel ratio determined in accordance with the invention to modify the air and fuel feed rates to effect the desired control. In that figure the fuel rate demand signal FRD is introduced on line 10 to the burner controls. That signal may be set by the operator or derived by any of a number of systems such as that shown in U.S. Pat. No. 3,247,671, issued to J. H. Daniels on Apr. 26, 1966, where the signal is shown on line 178 of said patent. That demand signal directly determines the fuel feed control by providing the setpoint for the fuel feed controller 12 which receives as its other input the signal on line 14 from flow transmitter 16 indicative of the measured flow of fuel. The controller 12 may be any of a number of standard controllers which can operate to vary the opening of control valve 18 as needed to cause the setpoint to be matched by the measured value of fuel flow.

The air flow needed to obtain the required air/fuel ratio in accordance with this invention can be obtained by using the optimum air/fuel ratio signal on line 20 to determine the relationship between the fuel feed rate and the air flow rate. Thus, as one example, the air flow in FIG. 2 is controlled from the fuel rate demand signal on line 10 by feeding forward that signal as the setpoint, SP, for air flow controller 22. The set point is modified by the function generator 24 whose output is then multiplied by the signal from line 20 to give the controller set point, SP', on line 26. The function generator is desired because the air/fuel ratio should be increased as load on the furnace is decreased, for there will be a decrease in fuel-air mixing.

As shown, the controller 22 modifies the air flow rate as needed to cause the measured air flow determined by flow transmitter 28 to equal the set point SP'. As shown in FIG. 2, the air flow is varied by adjustment of the air flow damper 29. In some installations the air flow may be modified by adjustment of forced and induced draft fans or other means. Also, in some installations the recalibration of the air flow system in accordance with the signal on line 20 may be accomplished on the measurement side by introducing the function generator and multiplier to the measurement side of the control instead of the set point side shown in FIG. 2.

Figure 3:
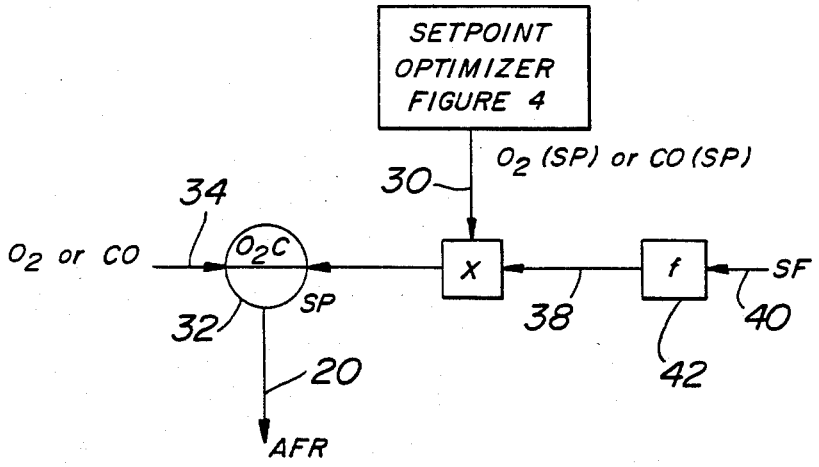
FIG. 3 illustrates another control configuration for adjusting the air/fuel ratio.

A variation of the air flow control system of FIG. 2 is shown in FIG. 3 where the output of the optimizing calculation provided on line 30 is representative of either the oxygen set point or the CO set point and is used to obtain the air/fuel ratio signal on line 20 which can then be used as shown in FIG. 2.

The system of FIG. 3 is useful to adjust the air/fuel ratio in a manner to account for varying fuel quality, heat of combustion, and errors in the measuring system. In this connection the signal on line 30 provides the set point for the oxygen controller 32, which in the alternative can be a CO controller. Assuming oxygen control is desired the oxygen measurement provided on line 34 is compared with the set point and the controller modifies the air/fuel ratio as represented by the signal on line 20 until the measured oxygen equals the set point. The signal on line 30 is multiplied by a signal on line 38 which is derived from a steam flow measurement on line 40, shown as an input to the function generator 42. The function generator serves to provide a change in the air/fuel ratio with load as represented by the steam flow, SF.

Figure 4A:
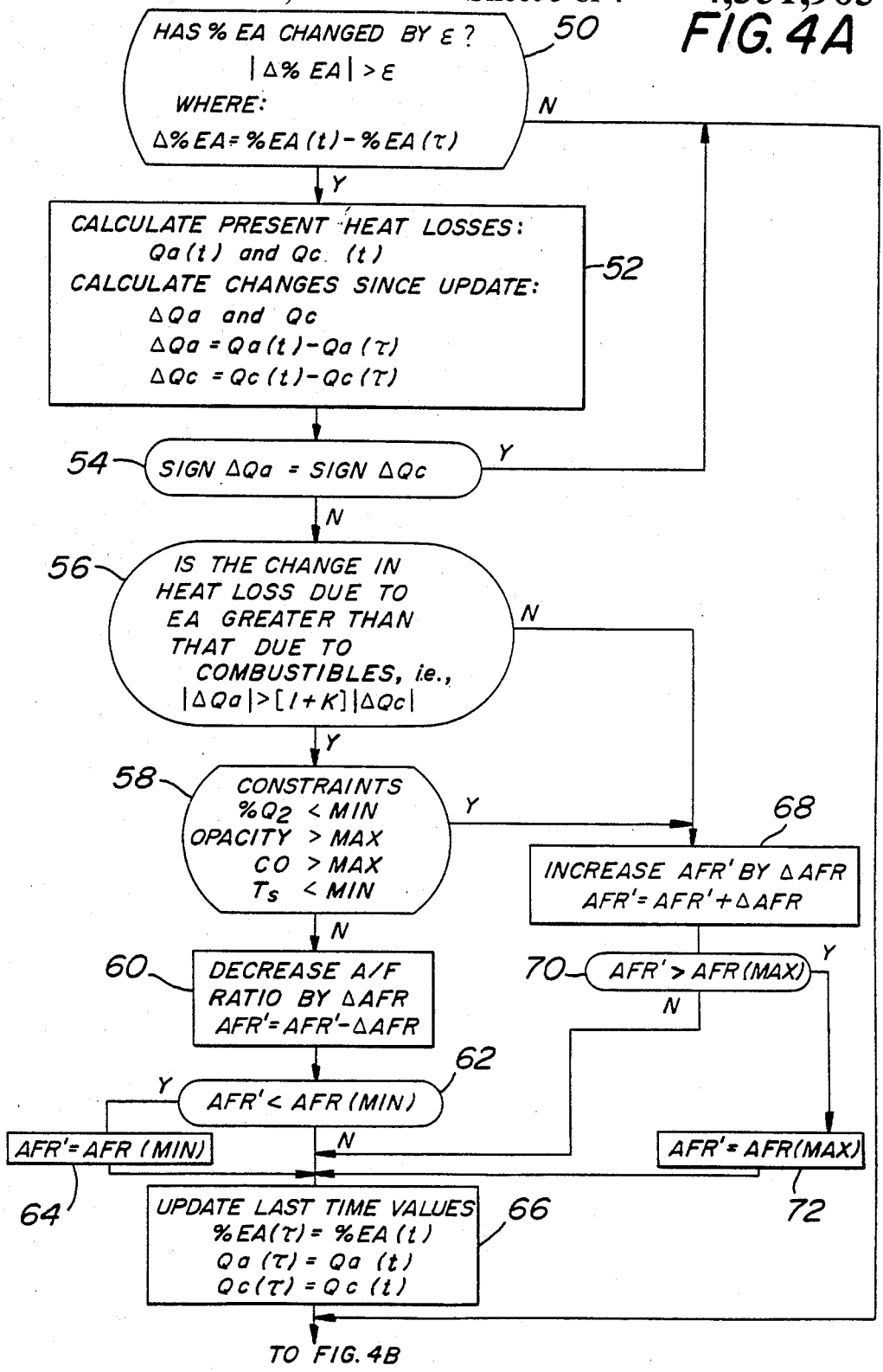
FIG. 4A provides an example of logical steps for carrying out the novel method of the invention by use of a digital computer.
Figure 4B:
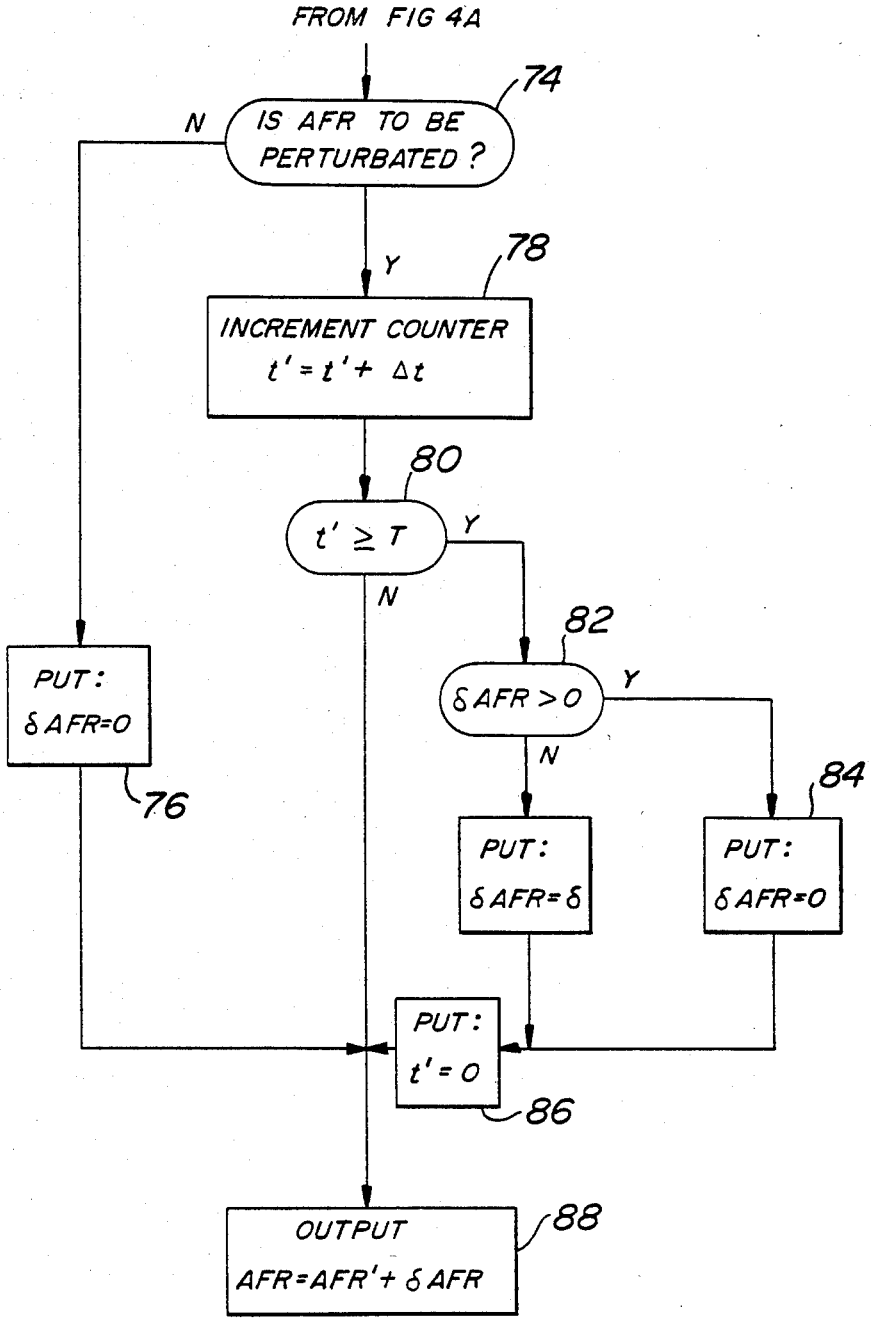
FIG. 4B provides the remaining logical steps for carrying out the invention.

FIGS. 4A and 4B show an example of the logical steps which can be used in a digital computer to produce the signal required on line 20 of FIG. 2 and, with modifications which will be described, the signal required for line 30 of FIG. 3.

In FIG. 4A the block 50 serves to bypass the optimizing program until a meaningful change has taken place in the excess air, i.e., the magnitude of Δ%EA is greater than a value ε. The change in EA is determined by subtracting the value stored at the last update %EA(τ) from the present value %EA(t), i.e., $$\Delta\%EA = \%EA(t) - \%EA(\tau). \quad (3)$$

The measurement of oxygen is indicative of EA in the area of interest and may be substituted directly in the above equation. The relationship between EA and oxygen is expressed by the following:

$$4.76\ \%0_2 = \%EA/[(1+\%EA)/100]. \quad (4)$$

As has been mentioned, the random fluctuations in fuel and/or air may result in a meaningful change in excess air, however, if that is not the case perturbations can be injected as will be described in an example in connection with FIG. 4B where the perturbation signal fluctuates between the values of zero and δ once during every time period T.

When a meaningful change in EA has been detected the present heat losses due to excess air and combustibles in the flue gases, Qa(t) and Qc(t) are calculated. The changes in heat losses, ΔQa and ΔQc are determined by comparing the present values to those stored at the last update, Qa(τ) and Qc(τ). This is accomplished in block 52.

The optimizing program is also bypassed if the expected sign changes are not observed i.e., if $$\text{sign } \Delta Qa = \text{sign } \Delta Qc \quad (5)$$

As can be seen from FIG. 1 an increase in the excess air will result in an increase in ΔQa and should result in a decrease in ΔQc. This sign check is made in block 54 of FIG. 4A.

When the optimizing path is taken in FIG. 4A, a check is made in block 56 to determine if the magnitude of the change in excess air loss is greater than the weighted change in losses due to combustibles, i.e., $$|\Delta Qa| > [1+K]^*|\Delta Qc| \quad (6)$$

If the answer is 'No' the stored value of the air/fuel ratio, AFR', is incremented by an amount ΔAFR in block 68 and will result in increasing the air/fuel ratio and, therefore, excess air, EA. For practical reasons maximum, AFR(MAX), and minimum, AFR(MIN), limits are applied to the value of AFR' as shown in blocks 62, 64, 70, and 72. If the answer is 'Yes' the stored value AFR' is decremented in block 60 by ΔAFR providing there are no constraint conditions discovered by the tests of block 58. This will result in decreasing AFR and, therefore, EA. If there are constraint conditions, e.g., based on percent oxygen less than a minimum, CO greater than a maximum, flue gas outlet temperature Ts less than a minimum, or opacity due to particulate greater than a maximum, as tested for in block 58, the value of AFR' will be increased by ΔAFR, as shown in block 68, and the value of AFR' will be checked for maximums and minimums, as mentioned before.

The optimizing calculations having been made and the desired value of the air/fuel ratio determined, the values of %EA, Qa, and Qc must be updated as shown in block 66.

After updating, the question of the need for perturbation of the air/fuel ratio is considered in block 74 of FIG. 4B. If the random fluctuations of the air/fuel ratio are sufficient as determined by the operator for the required perturbation then δAFR is set to zero, as shown in block 76. Otherwise, perturbations must be provided as mentioned before. This process is started by incrementing the counter as shown in block 78. The contents of the counter are then compared in block 80 to T, the period between perturbations.

If it is time for perturbations and δAFR is greater than zero, as determined by the test in block 82, then δAFR is set to zero (in block 84). Otherwise δAFR, the amount of change required in the air/fuel ratio to provide the needed purturbation, is set to δ. After δAFR is determined then the counter is set to zero, as shown in block 86.

The final desired value for the air/fuel ratio, the signal required for line 20 in FIG. 2, is then determined by adding δAFR to AFR' as shown in block 88.

The heat loss calculations for Qa and Qc can take a number of forms. However, for this invention only the relative changes are required and a form requiring the least calculations should be used. This is illustrated by the heat loss calculations set forth below.

Using the following definitions and terminology,

W—Total volume flow of the flue gas, cfh
$\%H_2$—$H_2$ content of the flue gas, % of total volume
%CO—CO content of the flue gas, % of total volume
$\%O_2$—$O_2$ content of the flue gas, % of total volume
4.75 $\%O_2$—Excess of air, % of total volume
qCO—Heating value in Btu per cubic foot of CO at atmospheric pressure, 328 Btu/cfh
$qH_2$—Heating value of $H_2$, 325 Btu/cfh
w—The volume in cubic feet occupied by 1 lb of air, 12.5 cfh/lb.
qA—Specific heat of air, 0.25 Btu/lb, °F.
°F—Degrees Fahrenheit, °F.
Qc—Heat losses due to incomplete combustion, BTU
ΔQc—Change in heat losses from combustion, Btu
Qa—Heat losses due to excess air, Btu
ΔQa—Change in heat losses from excess air, Btu
Ts—Flue gas outlet temperature, °F.
To—Ambient temperature, °F.

the heat losses due to incomplete combustion for the case considering only hydrogen and carbon monoxide may be calculated as $$Qc = [qH_2^*\%H_2 + qCO^*\%CO]^*W/100, \text{ Btu}, \quad (7)$$

the change in heat losses from combustibles may be expressed as $$\Delta Qc \approx [\Delta\%H_2 + \Delta\%CO]^*q^*W/100, \text{ Btu}, \quad (8)$$

where, $$q \approx qH_2 \approx qCO = 32 \quad (9)$$

If carbon can be measured, e.g., by opacity then equations (7) and (8) can be improved by adding a term kΔ%Opacity. If a hydrocarbon fuel is being used, the percent vaporization loss due to unburned hydrogen should be subtracted from the combustible losses.

The change in heat losses due to excess air Qa may be calculated as $$\Delta Qa = 4.76*\Delta\%O_2*(Ts-To)*[W*qA]/100*w, \text{ Btu.} \quad (10)$$

The minimum losses will occur when the rate of change in heat losses from combustibles equals the rate of change in stack heat losses due to a change in combustion air, i.e., when $$-\Delta Qc = \Delta Qa. \quad (11)$$

After substitution that equality may be expressed as $$-\Delta\%H_2 - \Delta\%CO = Ka*(Ts-To)*\Delta\%O_2 \quad (12)$$

where, $$Ka = [4.76*qA]/[q*w] = [4.76\times 0.25]/[325\times 12.5] \quad (13)$$

then, $$Ka = 2.9\times 10^{-4}. \quad (14)$$

The above equality may be used to calculate the present heat losses in FIG. 4A by defining Qc and Qa as follows, $$Qc(t) = \%H_2(t) + \%CO(t) \quad (15)$$

and $$Qa(t) = Ka*(Ts-To)*\%O_2(t). \quad (16)$$

Thus, the measurement of percent hydrogen, percent carbon monoxide, percent oxygen, the flue gas outlet temperature, and the ambient temperature are desired to provide the necessary inputs to a digital computer for carrying out the algorithm of FIG. 4.

The previous discussion has assumed the AFR was being adjusted directly, as shown in FIG. 2. Large furnaces may have a plurality of such air/fuel control loops. The AFR optimizer may be used to move all air/fuel ratios in unison or they may be moved individually. In the later case the loops are normally perturbated one at a time.

The same optimizing program shown in FIG. 4 may be used to adjust the $O_2$ setpoint when a trim control loop such as shown in FIG. 3 is used. The only change required is to replace the quantities of AFR with those for $O_2$(SP). It should be noted that an increase in $O_2$(SP) will result in an increase in AFR. Similarly, if a CO based trim controller is used the optimizing program may be used to adjust its setpoint, CO(SP). In this case, however, an increase in CO(SP) will result in a decrease of AFR, therefore, the increase and decrease of ΔAFR will be reversed in the program of FIG. 4.

What is claimed is:

1. A method for controlling the air/fuel ratio of a fossil fired furnace to optimize the output of the furnace under varying operating conditions, comprising the steps of:

measuring over a period of change in said air/fuel ratio the change in a first variable of the exhaust gases representative of the amount of combustibles present in said gases, calculating from said first variable the absolute value of the change in heat losses over said period due to the change in the amount of combustibles in said gases, measuring during said period the change in a second variable of the exhaust gases which is representative of the amount of excess air in said gases, and calculating from said second variable the absolute value of the change in heat losses over said period due to the change in the amount of excess air in said gases, automatically modifying the air/fuel ratio by increasing the air/fuel ratio when the absolute value of the change in heat loss due to excess air is less than that due to combustibles and decreasing the air/fuel ratio when the change in absolute value of the heat loss due to excess air is greater than that due to combustibles, to tend to maintain said calculated absolute value of the change in heat losses due to change in said first variable over said period equal to the calculated absolute value of the change in heat losses due to changes in said second variable over said period, thereby optimizing the furnace output.

2. The method of claim 1 in which said first variable includes at least the percent carbon monoxide content and said second variable is percent oxygen content.

3. The method of claim 1 in which said first variable includes at least the percent carbon monoxide content and the percent hydrogen content and said second variable is percent oxygen content.

4. The method of claim 1 in which said first variable includes percent carbon monoxide content, percent hydrogen content and percent opacity and the second variable is percent oxygen content.

5. The method of claim 1 in which said first variable is percent carbon monoxide content and percent opacity and the second variable is percent oxygen content.

6. The method of claim 1 in which said first variable includes percent carbon monoxide content.

7. The method as set forth in claim 1 in which the changes are the result of perturbations injected periodically.

8. The method as set forth in claim 1 in which the changes utilized for the measurements are those random variations which normally occur.

9. The method of claim 1 in which the automatic modification of the air/fuel ratio is accomplished by modifying the oxygen set point for control.

10. The method of claim 1 in which the automatic modification of the air/fuel ratio is accomplished by modifying the carbon monoxide set point for control.

11. The method of claim 1 in which the automatic modification of the air/fuel ratio is accomplished by modifying the set point of an oxygen controller which operates to modify the relationship of the combustion air flow and the fuel flow by maintaining equality between a measured value for the percent oxygen content of the flue gases and said set point.

12. The method of claim 1 in which the automatic modification of the air/fuel ratio is accomplished by modifying the set point of a carbon monoxide controller which operates to modify the relationship of the combustion air flow and the fuel flow by maintaining equality between a measured value for the percent carbon monoxide content of the flue gases and said set point.

13. The method of claim 1 in which the automatic modification of the air/fuel ratio is accomplished by modifying the set point of an air flow controller as established by a fuel rate demand signal so that said air flow controller operates to maintain the combustion air flow to the furnace equal to said set point with the fuel being controlled by a fuel controller which tends to maintain the fuel flow rate equal to said fuel rate demand signal.

14. The method of claim 1 in which the automatic modification of said air/fuel ratio is carried out by modifying the combustion air flow to said furnace.

15. The method for controlling the combustion air flow to a furance to minimize the total heat losses of said furnace under varying operating conditions, comprising the steps of:

periodically perturbing the combustion air flow, measuring both before and after said perturbations the percent carbon monoxide content of the flue gases, calculating from said carbon monoxide measurements the absolute value of the change in heat loss due to the change in the content of combustibles in said flue gases as a result of said perturbations, measuring both before and after said perturbations the percent oxygen content of the flue gases, calculating from said oxygen measurements the absolute value of the change in heat loss due to the change in excess air as a result of said perturbations, and modifying the combustion air flow to said furnace so as to tend to maintain said calculated changes in heat losses due to the change in said combustibles as a result of said perturbations equal to the calculated change in heat losses due to the change in said excess air flow and thereby minimize the total heat losses of said furnace.

16. The method of claim 15 which also includes the measurement of percent opacity before and after perturbation as an indication of further changes in heat losses due to changes in combustibles in the flue gases, said calculations of the changes in heat losses due to the change in combustibles including said opacity measurement.

* * * * *